United States Patent [19]

Matsumoto et al.

[11] Patent Number: 4,920,850

[45] Date of Patent: May 1, 1990

[54] ELECTRONIC MUSICAL INSTRUMENT WITH DATA MODIFICATION MEANS FOR MODIFYING OUTPUT SOUND

[75] Inventors: Naoaki Matsumoto; Kenichi Tsutsumi, both of Tokyo, Japan

[73] Assignee: Casio Computer Co., Ltd., Tokyo, Japan

[21] Appl. No.: 388,751

[22] Filed: Jul. 31, 1989

Related U.S. Application Data

[63] Continuation of Ser. No. 45,128, Apr. 30, 1987, abandoned.

[30] Foreign Application Priority Data

May 8, 1986 [JP] Japan ..... 61-103881

[51] Int. Cl.[5] ..... G10H 1/02; G10H 1/06; G10H 7/00

[52] U.S. Cl. ..... 84/622; 84/625; 84/626; 84/628; 84/477 R

[58] Field of Search ..... 84/622-633, 84/477 R, 478

[56] References Cited

U.S. PATENT DOCUMENTS

| | | | |
|---|---|---|---|
| 4,344,345 | 8/1982 | Sano | 84/1.03 |
| 4,352,311 | 10/1982 | Luce et al. | 84/1.19 |
| 4,476,766 | 10/1984 | Ishii | 84/1.19 X |
| 4,483,231 | 11/1984 | Hirano | 84/1.19 |
| 4,538,495 | 9/1985 | Sato | 84/477 R X |
| 4,554,857 | 11/1985 | Nishimoto | 84/1.19 |
| 4,624,170 | 11/1986 | Ohno et al. | 84/1.19 X |
| 4,785,707 | 11/1988 | Suzuki | 84/1.28 X |

*Primary Examiner*—Stanley J. Witkowski

*Attorney, Agent, or Firm*—Frishauf, Holtz, Goodman & Woodward

[57] ABSTRACT

Combinations of operation data such as timbre data, effect data, and the like, which are designated for a musical performance, are stored in a memory. The operation data is read out from the memory, and a musical tone signal corresponding to the readout operation data is generated and a musical tone is produced. Operation data is an operation mode can be transferred to, e.g., a normal mode, and a musical tone signal corresponding to the readout operation data can be generated and a musical tone can be produced in the normal mode. Operation data set in the normal mode can also be transferred to the operation mode. Part of the combined operation data can be easily updated.

8 Claims, 18 Drawing Sheets

ELECTRONIC MUSICAL INSTRUMENT WITH DATA MODIFICATION MEANS FOR MODIFYING OUTPUT SOUND

This application is a continuation, of application Ser. No. 07/045,128, filed Apr. 30, 1987 and now abandoned.

BACKGROUND OF THE INVENTION

The present invention relates to an electronic musical instrument which has a means for storing various combinations of operation data such as timbre or effect data for defining a performance state, and allowing a performance in accordance with the combined operation data.

In a conventional electronic musical instrument, a bank switch for selecting one of various combinations of operation data in an operation mode often serves as a timbre switch for selecting a timbre in a normal mode. It is impossible to update timbre data in set operation data in the operation mode. For this reason, the operation mode is first switched to the normal mode, and a desired timbre is set, and then the operation mode is again set. Finally, the bank switch is operated to update the timbre data. At this time, in the normal mode, various operation data combined in the operation mode cannot be transferred or used, and in order to check whether or not the updated timbre is an appropriate one, the operation mode must be set again, resulting in a cumbersome and time-consuming checking operation.

In the conventional instrument, once the operation data has been set in the normal mode, the normal mode is canceled, and the operation mode must be selected to store the operation data correspondence with any switch of the bank switches, and the same content as in the normal mode must be again set upon switch operation. This is a very cumbersome operation.

In order to update the content of the operation data, the operation mode is temporarily canceled to set a correction mode. In this mode, the operation data stored in an operation memory is corrected or new operation data is created, and the updated or new operation data is written in the operation memory.

However, in order to set the correction mode, the operation mode must be temporarily canceled, resulting in a cumbersome operation. In addition, a correction mode setting switch for setting the correction mode is necessary, and this results in a bulky instrument. In an instrument which newly creates the operation data, even when only timbre data is to be updated and other data need not be changed, all the data must be set, resulting in a very cumbersome operation.

SUMMARY OF THE INVENTION

It is a first object of the present invention to provide an electronic musical instrument in which operation data which is set in, e.g., a normal mode other than an operation mode, is stored in an operation data storage means, and after setting of the operation mode, musical tones can be produced using the operation data stored in the storage means.

It is a second object of the present invention to provide an electronic musical instrument in which operation data set in the operation mode is stored in an operation data storage means, and musical tones can be produced using the operation data stored in the storage means even in, e.g., a normal mode.

It is a third object of the present invention to provide an electronic musical instrument which can update a desired set of operation data from a plurality of operation data, and can store the updated set of operation data in an operation data storage means.

According to an aspect of this invention, there is provided an electronic musical instrument comprising;

operation data storage means for storing combinations of operation data such as timbre data, effect data, and the like which are designated for a musical performance;

operation data readout means for reading out the operation data from the operation data storage means, and tone generation means for generating a musical tone signal corresponding to the operation data read out by the operation data readout means and producing a corresponding musical tone;

the instrument further comprising:

operation data setting means for setting the operation data when a readout mode by the operation data readout means is canceled;

storage area designating means for designating a specific storage area of the operation data storage means; and operation data write means for writing the operation dta set by the operation data setting means into the storage area designated by the storage area designating means.

According to another aspect of this invention, there is provided an electronic musical instrument comprising;

operation data storage means for storing combinations of operation data such as timbre data, effect data, and the like which are designated for a musical performance;, operation data readout means for reading out the operation data from the operation data storage means, and tone generation means for generating a musical tone signal corresponding to the operation data read out by the operation data readout means and producing a corresponding musical tone;

the instrument further comprising:

readout canceling means for canceling the readout mode by the operation data readout means;

operation data holding/storing means for holding and storing the operation data which is being read out from the operation data storage means by the operation data readout means when the readout mode is canceled by the canceling means; and operation data transfer means for supplying the operation data held and stored in the holding/storing means to the tone generation means.

According to still another aspect of this invention, there is provided an electronic musical instrument comprising;

operation data storage means for storing combinations of operation data such as timbre data, effect data, and the like which are designated for a musical performance;

operation data readout means for reading out the operation data from the operation data storage means; and tone generation means for generating a musical tone signal corresponding to the operation data read out by the operation data readout means and producing a corresponding musical tone;

the instrument further comprising:

operation data updating means for updating part or all of a content of readout operation data while the operation data is read out by the operation data readout means;

operation data write means for writing the operation data updated by the operation data updating means into the operation data storage means; and operation data transfer means for transferring operation data in a specific storage area of the operation data storage means to another storage area of the operation data storage means.

DETAILED DESCRIPTION OF THE PREFERRED EMBODIMENT

An embodiment of the present invention will now be described with reference to the accompanying drawings.

Arrangement of Panel Switch Section

Figure 1:
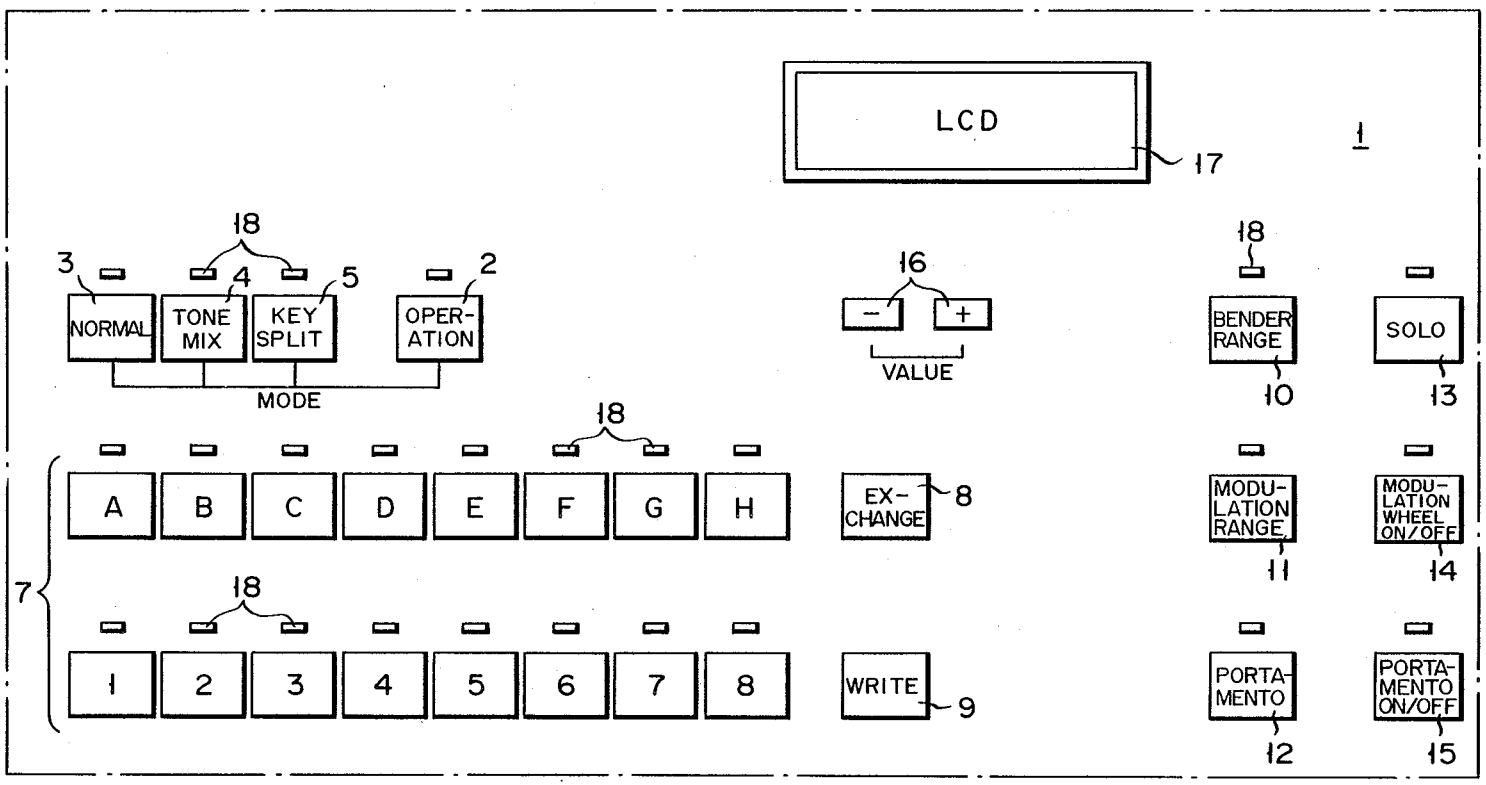
FIG. 1 is a view showing the arrangement of panel switch section 1.
Figure 2:
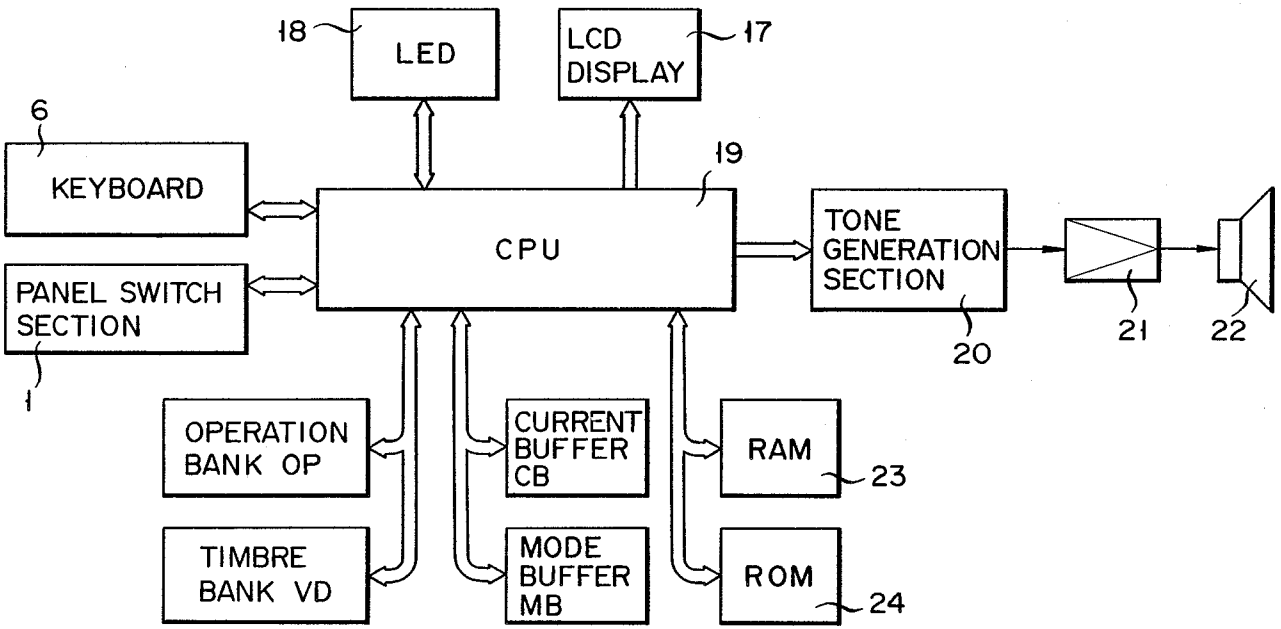
FIG. 2 is a circuit diagram of the entire electronic musical instrument.

FIG. 1 shows switches of panel switch section 1. Reference numeral 2 denotes an operation switch for setting an operation mode in which a performance corresponding to the content of a preset one operation data item including timbre data, effect data, and the like is performed. Normal switch 3, tone mix switch 4, and key split switch 5 are arranged on the left side of operation switch 2. Switches 3 to 5 are used to cancel the operation mode. Normal switch 3 sets a mode for assigning a single timbre to keyboard 6 after the operation mode is canceled. Tone mix switch 4 sets two timbres for each key of keyboard 6 after the operation mode is canceled. Key split switch 5 splits keyboard 6 into two key areas, and assigns different timbres to the respective key areas after the operation mode is canceled. The normal, tone mix, and key split modes, other than the operation mode, will be called "the 3 modes" hereinafter. In the operation mode, the normal, tone mix, and key split modes can be set. Sixteen bank switches 7 (switch Nos. A to H and 1 to 8) are arranged below mode setting switches 2 to 5.

Bank switches 7 are acting as operator means are used to set or operation data, such as timbre data, effect data, and the like in the operation mode, and to set or read out timbre data in the 3 modes such as the normal mode. Bank switches 7 can set 64 operation data upon combination of switch Nos. A to H and 1 to 8, like "A-1", "C-7", and so on. Exchange switch 8 and write switch 9 are arranged on the right side of bank switches 7.

Exchange switch 8 is adopted to exchange specific two of the 64 operation data. Write switch 9 is adopted to transfer operation data without clearing it when the mode switching operation is performed between the operation mode and the 3 modes. Bender range switch 10, modulation range switch 11, portamento switch 12, solo switch 13, modulation wheel on/off switch 14, and portamento on/off switch 15 are arranged on the right portion of panel switch section 1.

Bender range switch 10 and modulation range switch 11 are used to set modes for changing ranges capable of modulating a pitch bender or a modulation wheel (neither are shown). Portamento switch 12 is adopted to set a mode for changing a frequency changing rate of portamento effect. Solo switch 13 is used to select whether a single or a plurality of musical tones are to be produced. Modulation wheel on/off switch 14 and portamento on/off switch 15 are used to switch whether the modulation or portamento effect by means of the modulation wheel is made valid or invalid.

LCD display 17 is arranged on the upper portion of panel switch section 1, and displays the content of operation data and various messages. Value switch 16 is arranged below LCD display 17. Value switch 16 is used to increase or decrease a data value when an effect update mode is set upon operation of bender range switch 10, modulation range switch 11, or portamento switch 12 and the setting data value is displayed on LCD display 17.

Panel switch section 1 also includes timbre setting switches (not shown) for setting piano timbre, guitar timbre, and the like. When operation data or timbre data is set, these switches are turned on in correspondence with bank switches 7.

LEDs 18 are arranged on switches 2 to 5, 7, and 10 to 15, respectively, and are turned on when the corresponding switches are turned on.

Overall Circuit Arrangement

Operation data or timbre data input at panel switch section 1 is written in operation bank OP or timbre bank VD under the control of CPU 19. Operation data in operation bank OP or timbre data in timbre bank VD is set in current buffer CB by CPU 19. Data set in current buffer CB is sent to tone generation section 20 by CPU 19. Section 20 generates a musical tone signal in accordance with the content of supplied operation data or timbre data, and a corresponding musical tone is produced from loudspeaker 22 through amplifier 21.

The operation content of switches of panel switch section 1 is set in mode buffer MB by CPU 19 in the 3 modes, and is set in operation bank OP by CPU 19 in the operation mode. Operation data set in mode buffer MB in the 3 modes is transferred to current buffer CB and operation bank OP during an operation data save operation. Conversely, the operation data set in current buffer CB in the operation mode is transferred to mode buffer MB during an operation data load operation.

LEDs 18 for the switches corresponding to the content of mode buffer MB are turned on, and a setting data value of effect data is displayed on LCD display 17.

RAM 23 incorporates registers necessary for various data processing operations, and ROM 24 stores a control program for CPU 19.

Arrangements of Buffers MB and CB and Banks OP and VD

Figure 3:
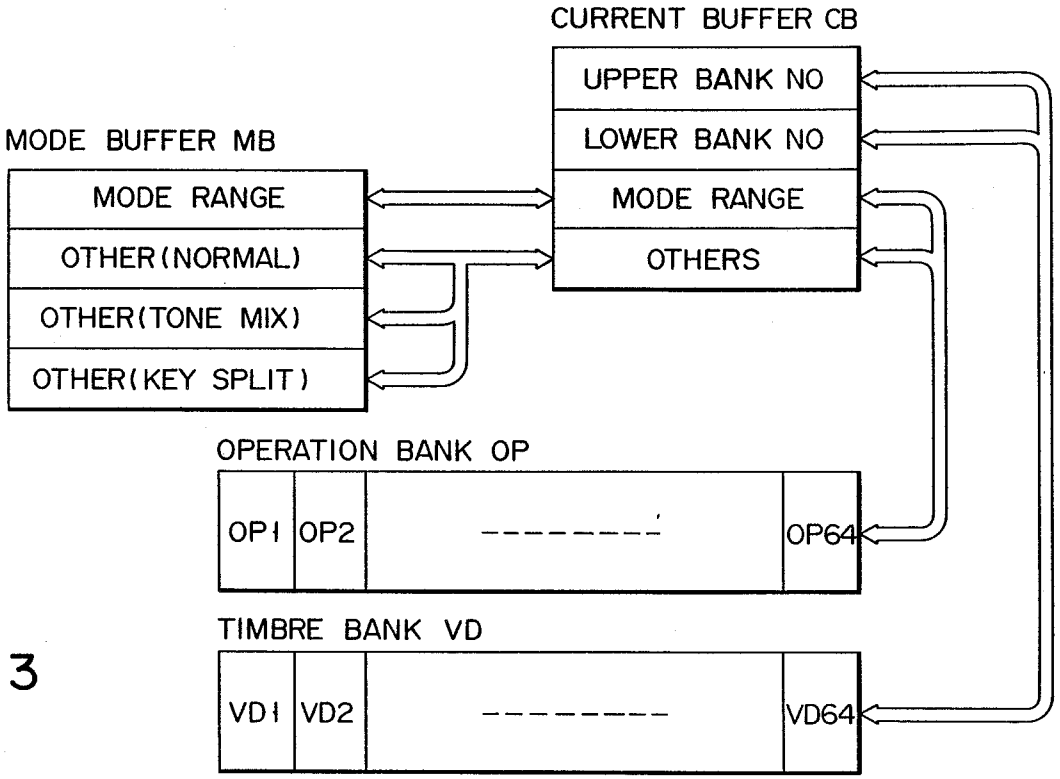
FIG. 3 shows a memory map of buffers MB and CM and banks OP and VD.

FIG. 3 shows the detailed arrangements of mode buffer MB, current buffer CB, operation bank OP, and timbre bank VD. Timbre data selected from timbre bank VD is set in upper and lower bank number areas of current buffer CB. "Upper" indicates an upper key area, and "lower" indicates a lower key area. Since two timbres are necessary in the key split and tone mix modes, timbre data are set in both the upper and lower areas. However, in the normal mode, timbre data is set in only the lower area.

Of operation data from operation bank OP, normal, tone mix, and key split mode data, and bender range, modulation range, and portamento data are set in a mode/range area of current buffer CB, and other data is set in "other" areas. Mode data and range data are set in the mode/range area of mode buffer MB, and other data is set in "other" areas thereof. Three "other" areas are provided in correspondence with the normal, tone mix, and key split modes, and data is set in the area corresponding to each mode.

Data Content of Operation Data

Figure 4:
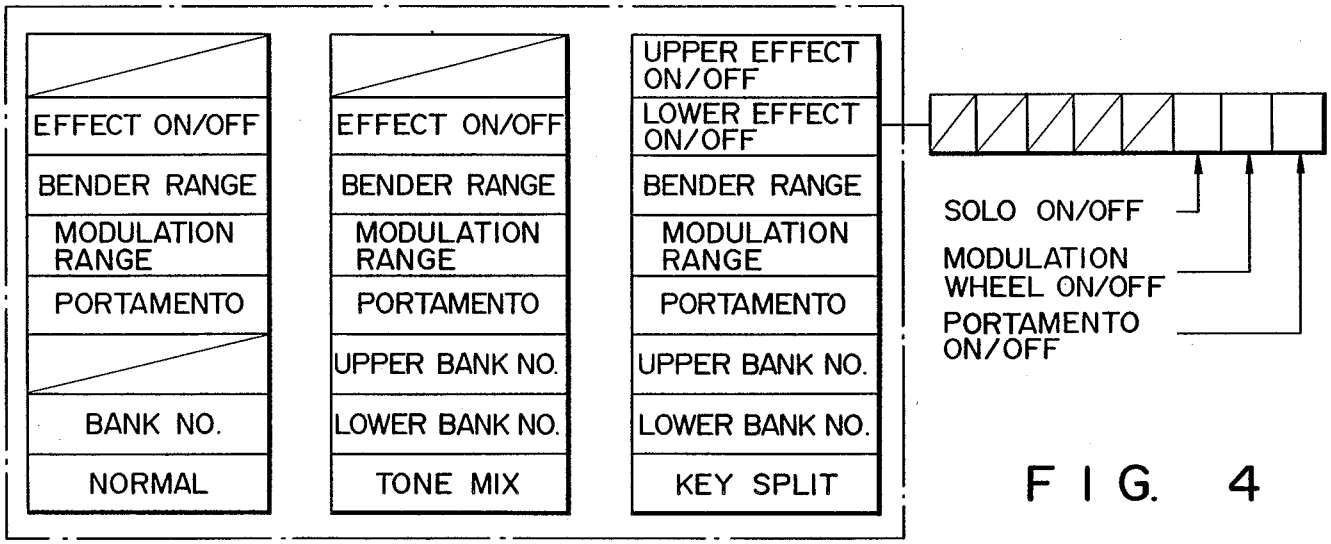
FIG. 4 shows a format of the content of operation data.

FIG. 4 shows the data contents of operation data in operation bank OP, respectively in the normal, tone mix, and key split modes from the left of the drawing. In the operation data, upper (upper key area) and lower (lower key area) effect on/off data, bender range data, modulation range data, portamento data, upper and lower bank number data, and mode data are set in the order named. In the normal and tone mix modes, since keyboard 6 is not split, upper effect on/off data is not set. In the normal mode, since two timbres are not used, upper bank number data is not set.

The effect on/off data consists of three data bits respectively indicating on/off of the solo switch, of the modulation wheel on/off switch, and of the portamento on/off switch, as shown in the right end of FIG. 4.

Arrangements of Register in RAM 23

Figure 5:
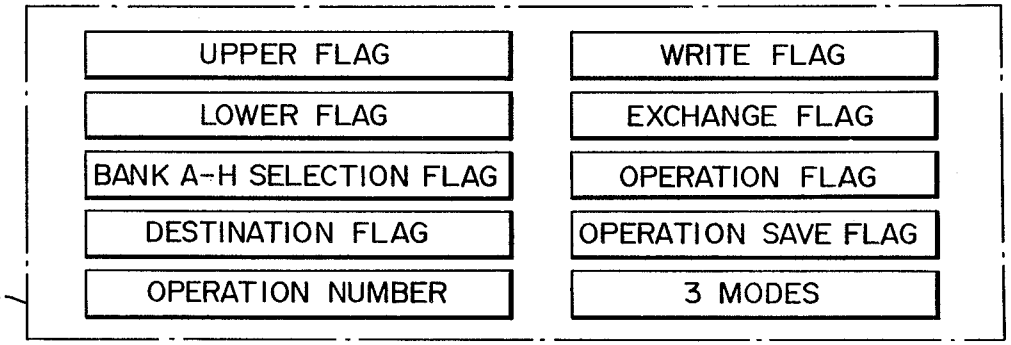
FIG. 5 shows a memory map of registers in RAM 23.

FIG. 5 shows registers of RAM 23. Upper and lower flags indicate whether upper- or lower-side LEDs on solo switch 13, modulation wheel on/off switch 14, and portamento on/off switch 15 are turned on. A bank A-H selection flag is set when one of switch Nos. A to H of bank switches 7 is first operated upon operation of switch Nos. A to H and 1 to 8 of switches 7. An operation number currently selected by the corresponding switch 7 is set in an operation number register. One operation number is set in a destination number register when copy processing or exchange processing of operation data is performed. In this case, the other operation number is set in the operation number register.

Write and exchange flags are set respectively when write and exchange switches 9 and 8 are turned on. An operation flag is set in the operation data. An operation save flag is set in an operation save mode in which data transfer is performed from mode buffer MB to current buffer CB. 3-mode flags are set in correspondence with the normal, tone mix, and key split modes other than the operation mode.

Operation of Embodiment

The operation of this embodiment will now be described.

The operation of this embodiment includes the following eight operations.

Processing from power-on to power-off
Panel switch processing
Operation mode setting and canceling processing
Operation data update processing in the operation mode
Operation data transfer (copy, exchange) processing
Operation data transfer (save) processing upon setting of the operation mode
Operation data transfer (load) processing upon canceling of the operation mode
Switch off processing The seventh operation data transfer (load) processing corresponds to the characteristic feature of the present invention.

Processing from power-on to power-off

Figure 6:
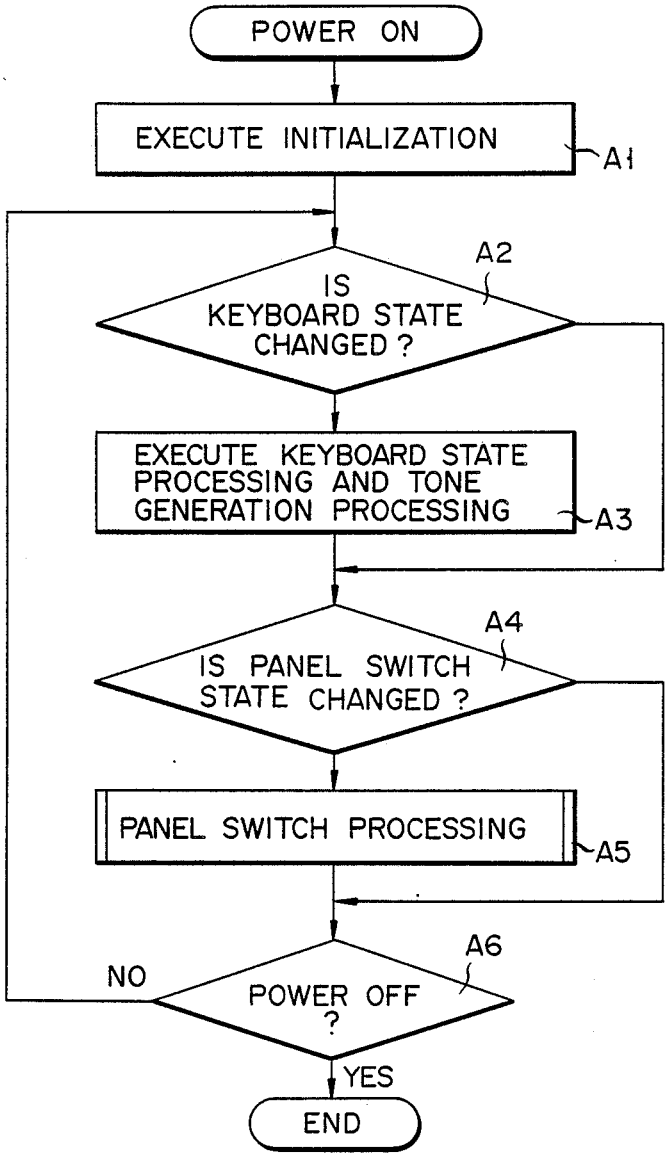
FIGS. 6 to 9, FIGS. 11A to 13, FIG. 15, FIG. 16, and FIG. 18 are flow charts respectively showing general processing, panel switch processing, mode switch processing, mode state setting processing, bank switch processing, effect on/off processing, effect value display processing, value +, − switch processing, write-/exchange processing, and switch off processing.

FIG. 6 shows the processing from power-on to power-off. Upon power-on, CPU 19 initializes LEDs 18, LCD display 17, RAM 23, current buffer CB, and mode buffer MB (step A1). If a change in key state of keyboard 6 is detected, CPU 19 sends a key-on or key-off code to tone generation section 20 to perform tone generation processing or tone off processing (steps A2 and A3).

If a change in switch operation state of panel switch section 1 is detected, panel switch processing corresponding to the operated switch is performed (steps A4 and A5), and the processing in steps A2 to A5 is repeated until power-off (step A6).

Panel switch processing

Figure 7A:
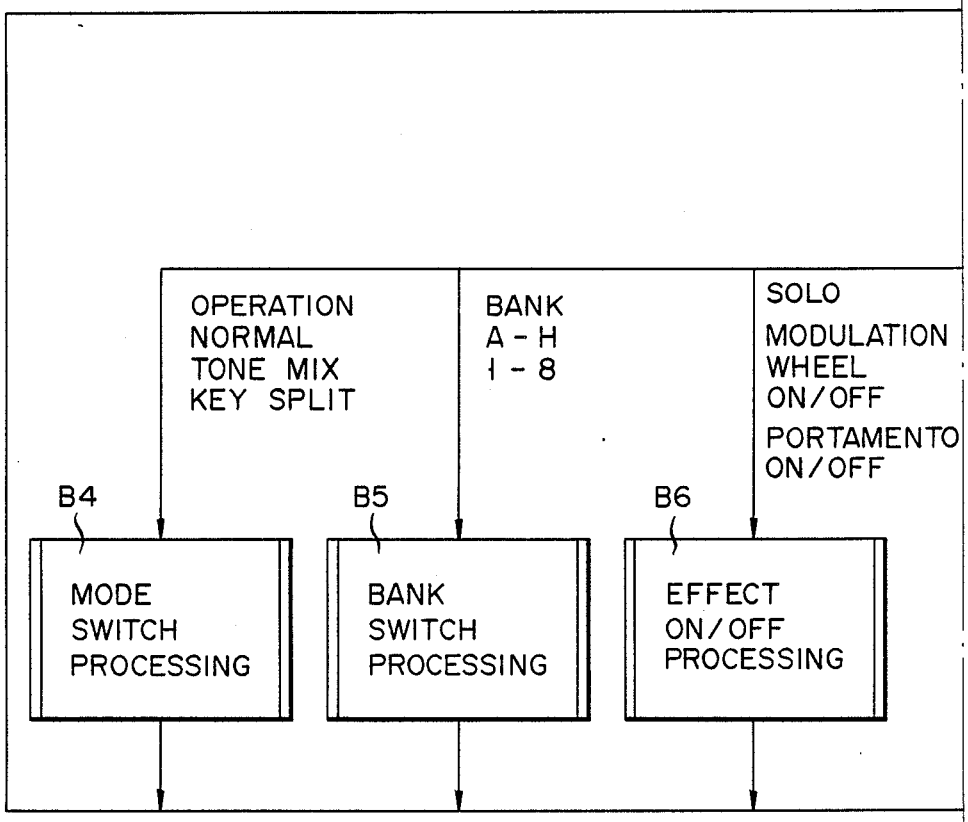
Figure 7B:
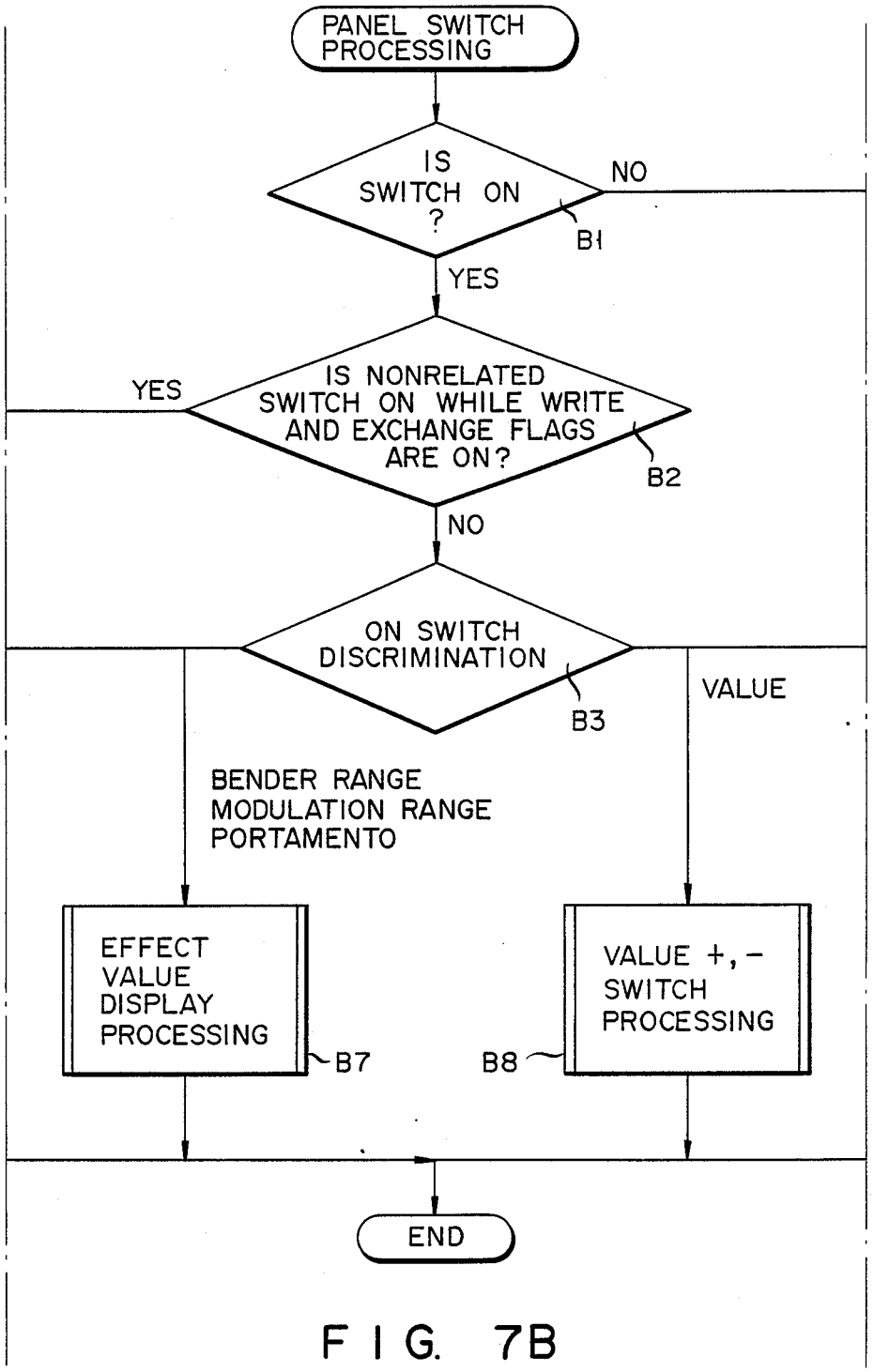
Figure 7C:
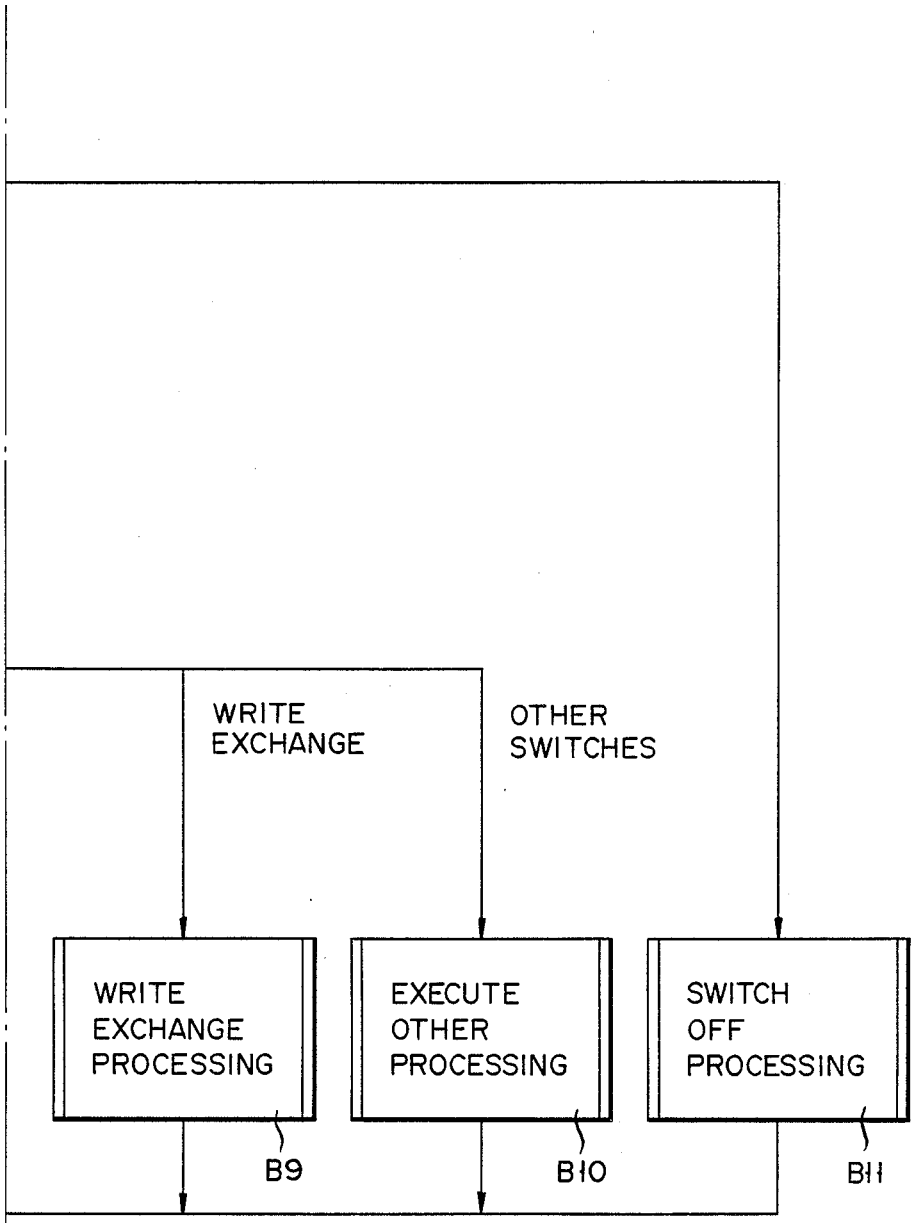

FIGS. 7A to 7C show the detailed flow of the panel switch processing in step A5 in FIG. 6. If it is detected in step B1 that a switch is turned on and if it is detected in step B2 that the ON switch is not associated with write and exchange switches 9 and 8, no processing is performed. If the ON switch is one of operation switch 2, normal switch 3, tone mix switch 4, and key split switch 5, mode switch processing is performed (steps B3 and B4). If the ON switch is one bank switch 7, bank switch processing is performed (steps B3 and B5). If the ON switch is one of solo switch 13, modulation wheel on/off switch 14, and portamento on/off switch 15, effect on/off processing is performed (steps B3 and B6). If the ON switch is one of bender range switch 10, modulation range switch 11, and portamento switch 12, effect value display processing is performed (steps B3 and B7). If the ON switch is value switch 16, value +, − switch processing is performed (steps B3 and B8). If the ON switch is write switch 9 or exchange switch 8, write/exchange processing is performed (steps B3 and B9). If the ON switch is another switch, other processing corresponding thereto is performed (steps B3 and B10). If the switch operation content corresponds to a change from an ON state to an OFF state, switch off processing is performed (step B11).

Operation mode setting and canceling processing

Figure 8:
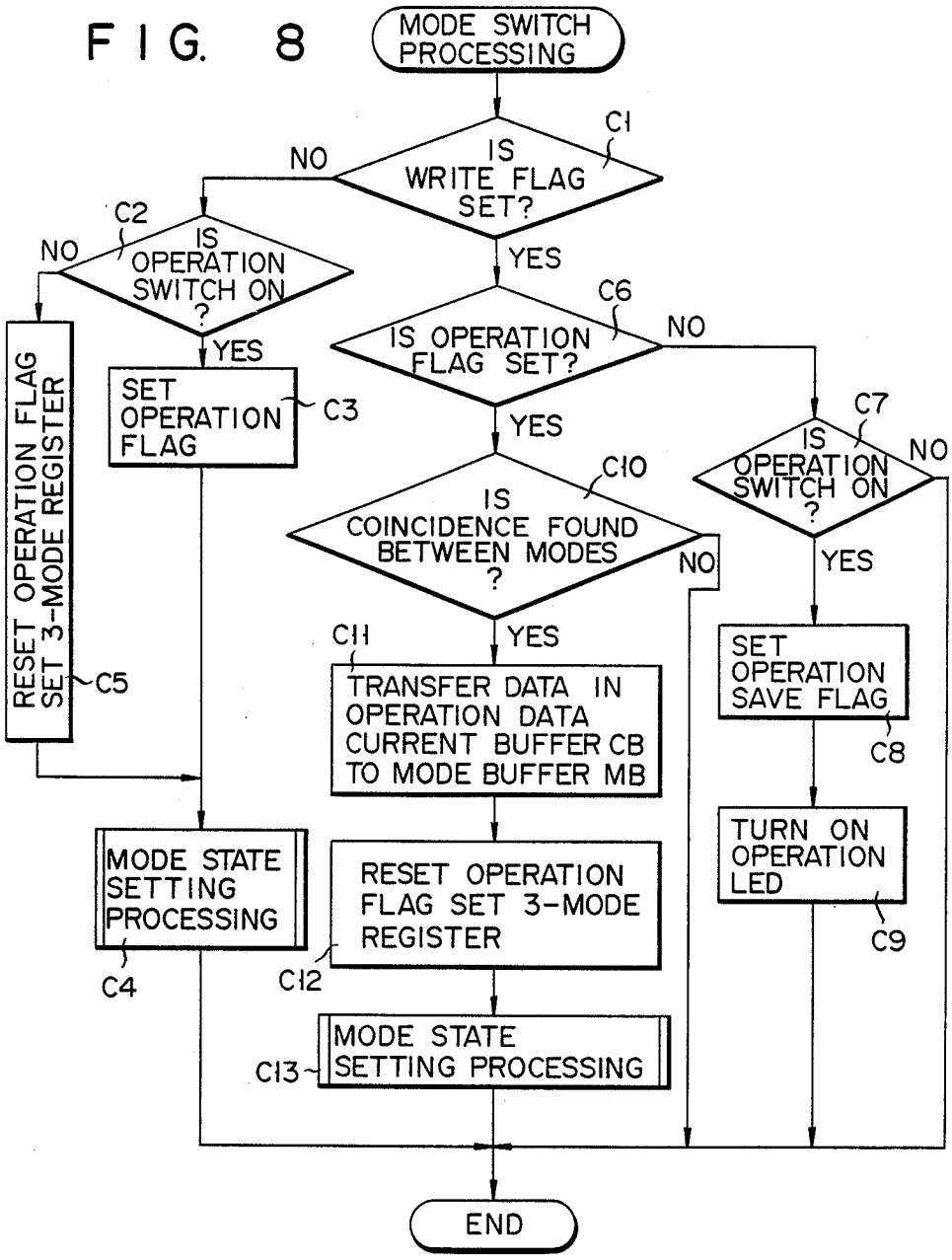

In order to set the operation mode, operation switch 2 is turned on. Then, the mode switch processing shown in FIGS. 7A to 7C is carried out. More specifically, as shown in FIG. 8, CPU 19 determines that a write flag is not yet set in RAM 23 (step C1), and thereafter, determines the ON state of operation switch 2 (step C2). Then, CPU 19 sets the operation flag (step C3), and performs mode state setting processing (step C4). Thus, the operation mode is set.

Figure 9:
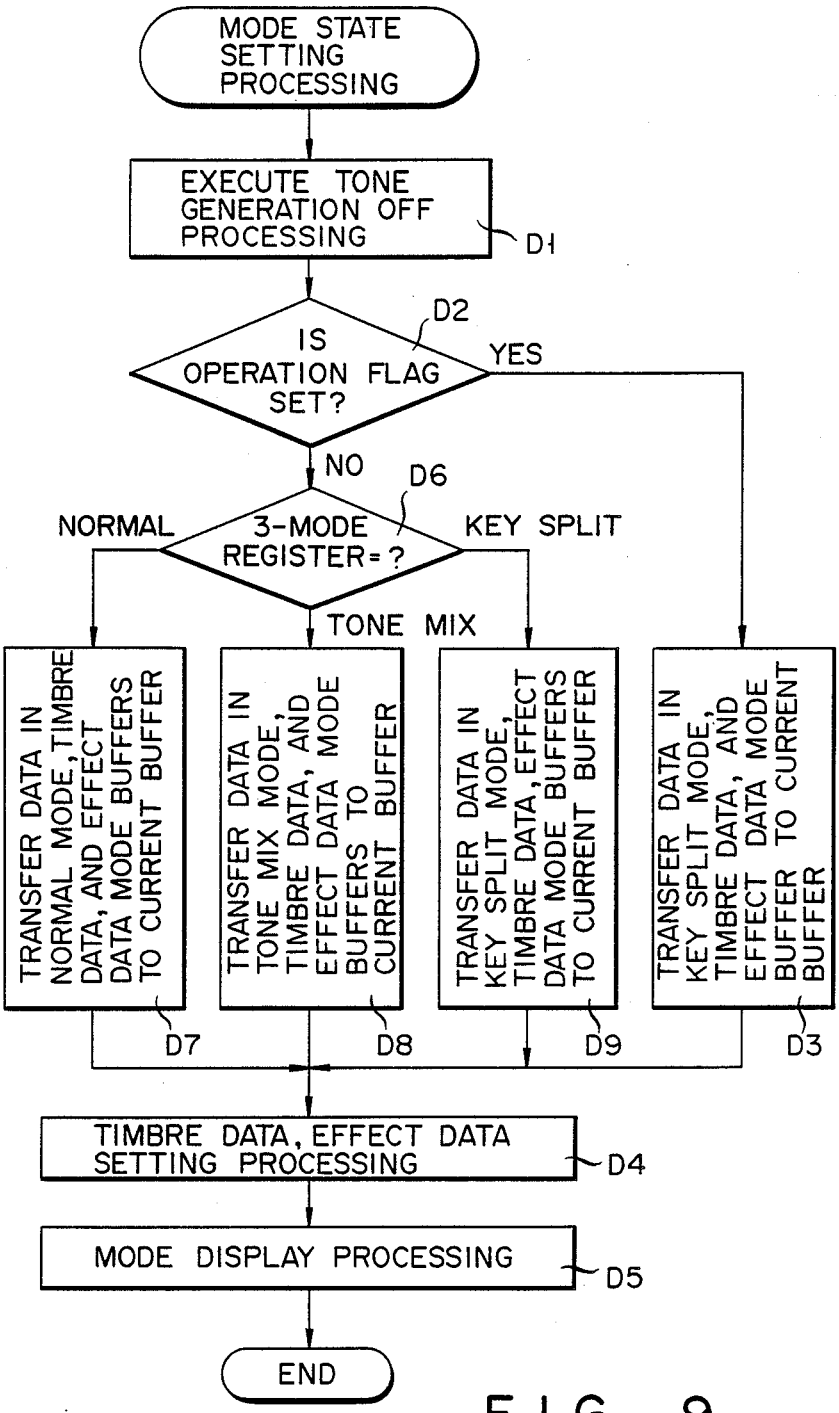

The processing in step C4 is shown in detail in FIG. 9. CPU 19 turns off a musical tone which is being produced (step D1), and checks if the operation flag is set (step D2). Since the operation flag has already been set in step C3, CPU 19 reads out operation data from the corresponding bank area of operation bank OP designated by bank switch 7 and sets readout data in current buffer CB (step D3). CPU 19 then transfers operation data in current buffer CB to RAM 23 and tone generation section 20 to allow musical tone production corresponding to the operation data (step D4). Thereafter, CPU 19 performs mode display processing (step D5). Thus, musical tones can be produced in accordance with the operation data.

Figure 10:
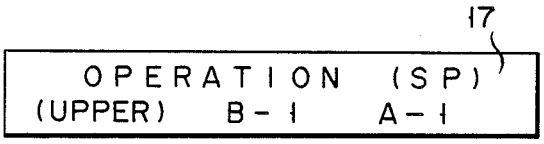
FIGS. 10, 14, and 17 are illustrations showing mode, value, and bank select message displays, respectively.

As the display content by the mode display processing in step D5, the current mode, the display contents of LEDs 18 of solo switch 13, modulation wheel on/off switch 14, and portamento on/off switch 15, i.e., effect contents, and indication of an upper (upper key area) or lower (lower key area) side capable of switching the bank number, a timbre bank number of the upper key area, and a timbre bank number of the lower key area are displayed, as shown in FIG. 10. In this case, the display contents for the upper and lower sides can be switched upon operation of value switch 16 in steps H1 and H2 in FIG. 15, thereby switching the setting state of the upper or lower flag in RAM 23 shown in FIG. 5.

In the operation mode, when the content of operation data is switched to that of another bank, desired bank switch 7 can be turned on. Processing in step B5 is then executed. More specifically, CPU 19 determines in step E1 (FIG. 11B) that neither the write nor exchange flag is set, and thereafter determines in step E2 that the operation flag has already been set in step C3. Then, CPU 19 reads out operation data from the corresponding bank area of operation bank OP designated by bank switch 7 and sets the readout data in current buffer CB (step E3). In this manner, the operation data can be switched.

In this case, if the operation mode is not set and hence, the operation flag is not set (step E2), timbre data is read out from the corresponding bank area of timbre bank VD designated by bank switch 7, and sets the readout data in current buffer CB (step E4). When the operation mode is not set, only the timbre data is switched.

In order to cancel the operation mode, any of normal switch 3, tone mix switch 4, and key split switch 5 can be turned on. CPU 19 then executes the mode switch processing in step B4 shown in FIGS. 7A to 7C. More specifically, as shown in FIG. 8, after CPU 19 determines in step C1 that the write flag is not yet set and in step C2 that operation switch 2 is not turned on, CPU 19 resets the operation flag, and a mode flag corresponding to the operated one of switches 3 to 5 is set in the 3-mode register of RAM 23 (step C5), thereby executing the mode state setting processing (step C4).

In the mode state setting processing, as shown in FIG. 9, after the tone generation off processing (step D1), it is determined in step D2 that the operation flag is reset in step C5. Then, the mode flag, timbre data, effect data, and the like in mode buffer MB are transferred to current buffer CB (steps D6 to D9). In this case, data set at panel switch section 1 before the canceled operation mode is set in mode buffer MB, and a state before setting the operation mode is resumed. Subsequently, CPU 19 sets various data in tone generation section 20, and executes mode display processing in steps D4 and D5.

Operation data update processing in the operation mode

Figure 12:
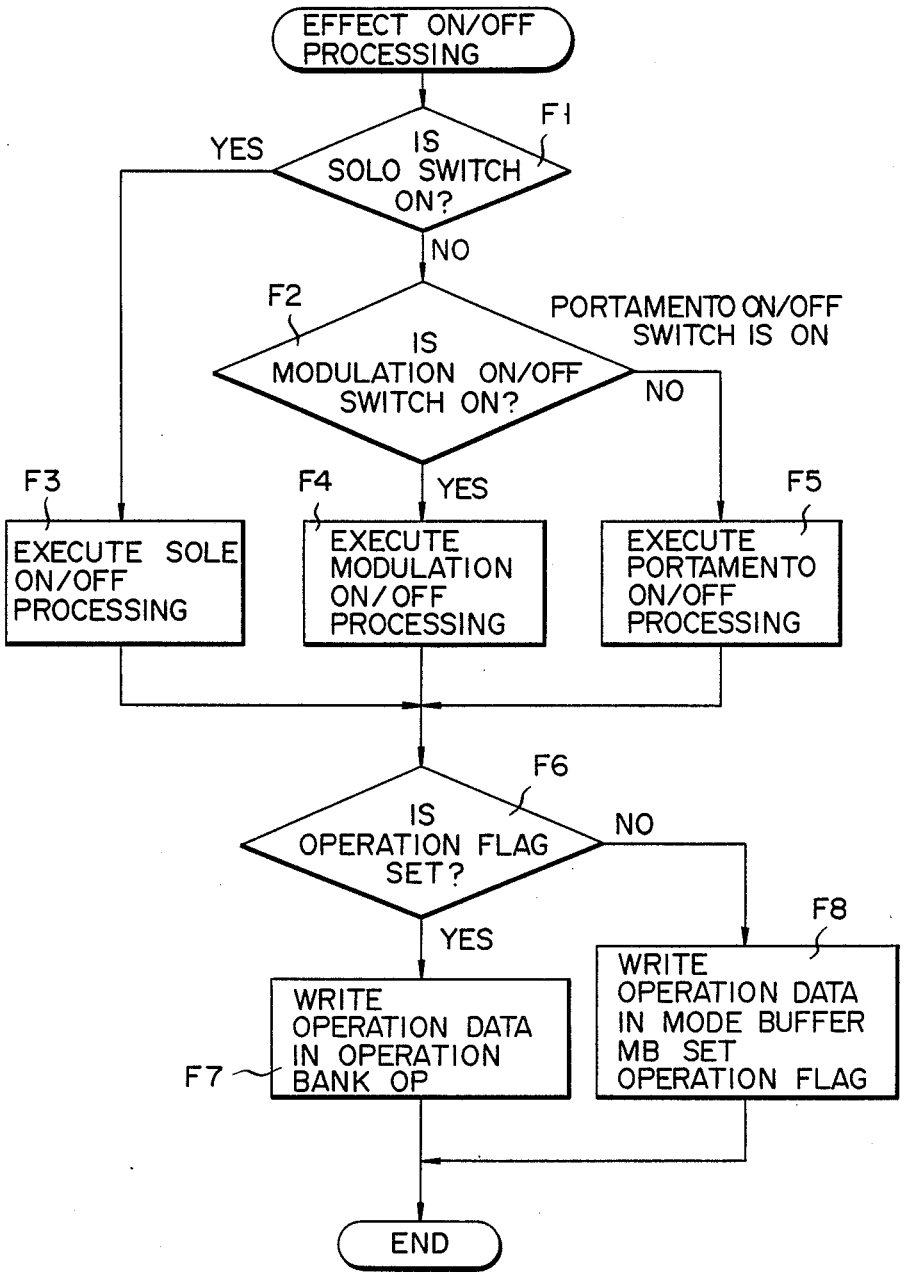

In the solo, modulation, and portamento on/off data, and bender range, modulation range, and portamento data of operation data can be updated. If any of solo switch 13, modulation wheel on/off switch 14, and portamento on/off switch 15 is turned on, CPU 19 executes effect on/off processing in step B6 in FIGS. 7A to 7C. More specifically, as shown in FIG. 12, CPU 19 determines in steps F1 and F2 which one of switches 13 to 15 is turned on, and inverts an ON flag ("1") or an OFF flag ("0") of the corresponding one of solo on/off data, modulation on/off data, and portamento on/off data in current buffer CB, accordingly (steps F3 to F5).

CPU 19 then checks if the operation flag is set (step F6). Since the operation mode is currently set, the flow advances to step F7, and CPU 19 writes operation data in current buffer CB which has been rewritten in any of steps F3 to F5 in a bank area of operation bank OP selected by bank switch 7 (step F7).

Specific data of the operation data can be easily updated without setting the correction mode. This also applies to an effect value such as a bender range, as will be described below.

Figure 13:
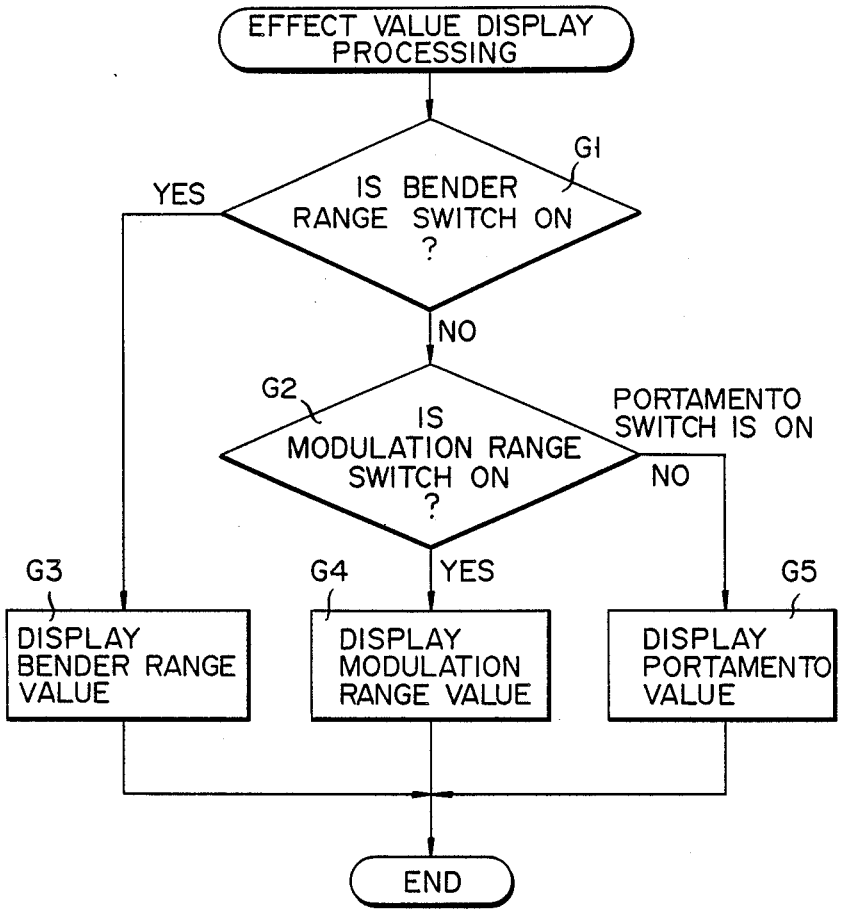

Assuming that any of bender range switch 10, modulation range switch 11, and portamento switch 12 is turned on and value switch 16 is turned on, CPU 19 executes the value +, − switch processing in step B8 after the effect value display processing in step B7 shown in FIGS. 7A to 7C. More specifically, CPU 19 determines which one of switches 10 to 12 is turned on (steps G1 and G2 in FIG. 13), and reads out value data of the corresponding one of bender range data, modulation range data, and portamento data and displays the readout data, as shown in FIG. 4 (steps G3 to G5).

Figure 15:
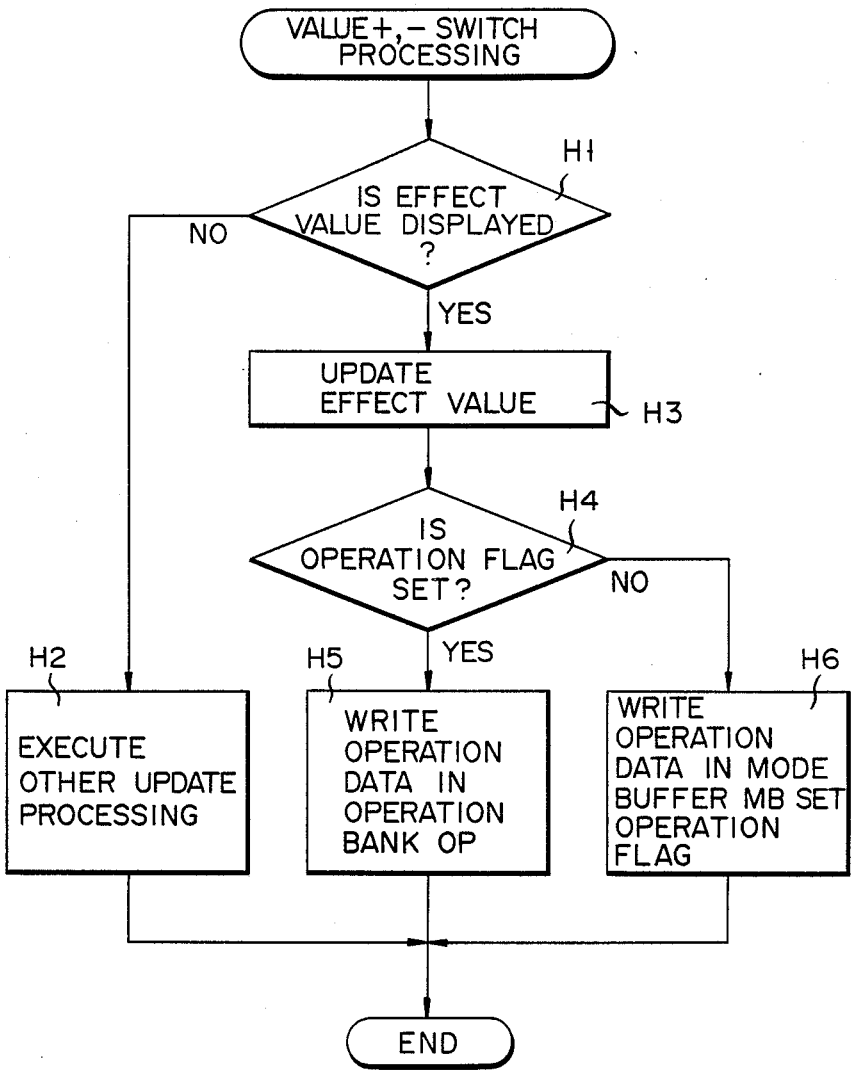

After value switch 16 is turned on, CPU 19 determines in step H1 that an effect value such as a bender range is displayed in steps G3 to G5, as shown in FIG. 15. CPU 19 then updates the effect value data such as bender range data in current buffer CB, and transfers the updated data to mode buffer MB (step H3).

CPU 19 then checks if the operation flag is set (step H4). Since the operation mode is currently set and hence, the operation flag is set, the flow advances to step H5, and CPU 19 writes operation data in current buffer CB in the bank area of operation bank OP selected by bank switch 7 (step H5).

In this manner, specific data of operation data can be easily updated without setting the correction mode.

Operation data transfer (copy, exchange) processing

When operation data is to be copied, operation switch 2 is turned on to set the operation mode, and the bank area of the operation data to be copied is designated by corresponding bank switch 7 to read out the corresponding data in current buffer CB and to set the bank area number in the operation number register of RAM 23. The detailed processing has been described in the paragraph "Operation mode setting and canceling processing", and is omitted herein.

Figure 16:
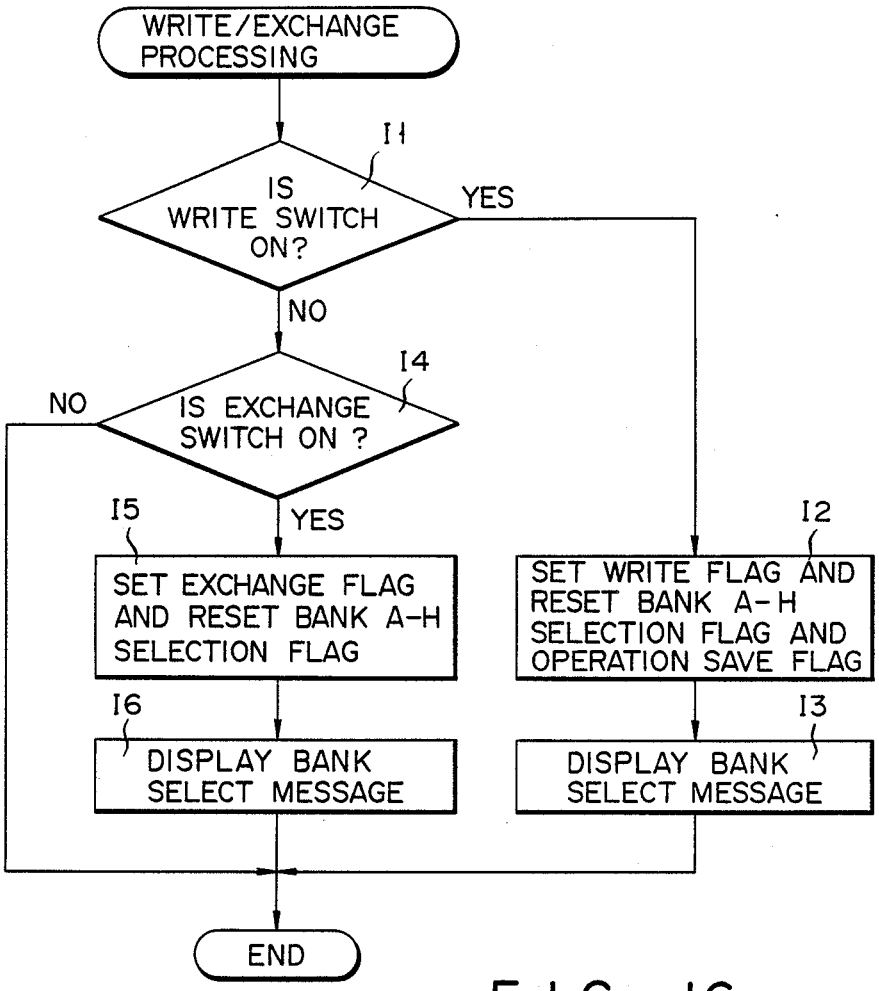
Figure 17:
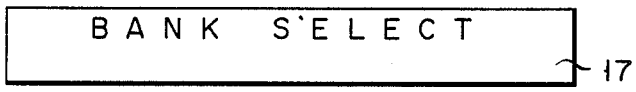
Figure 18:
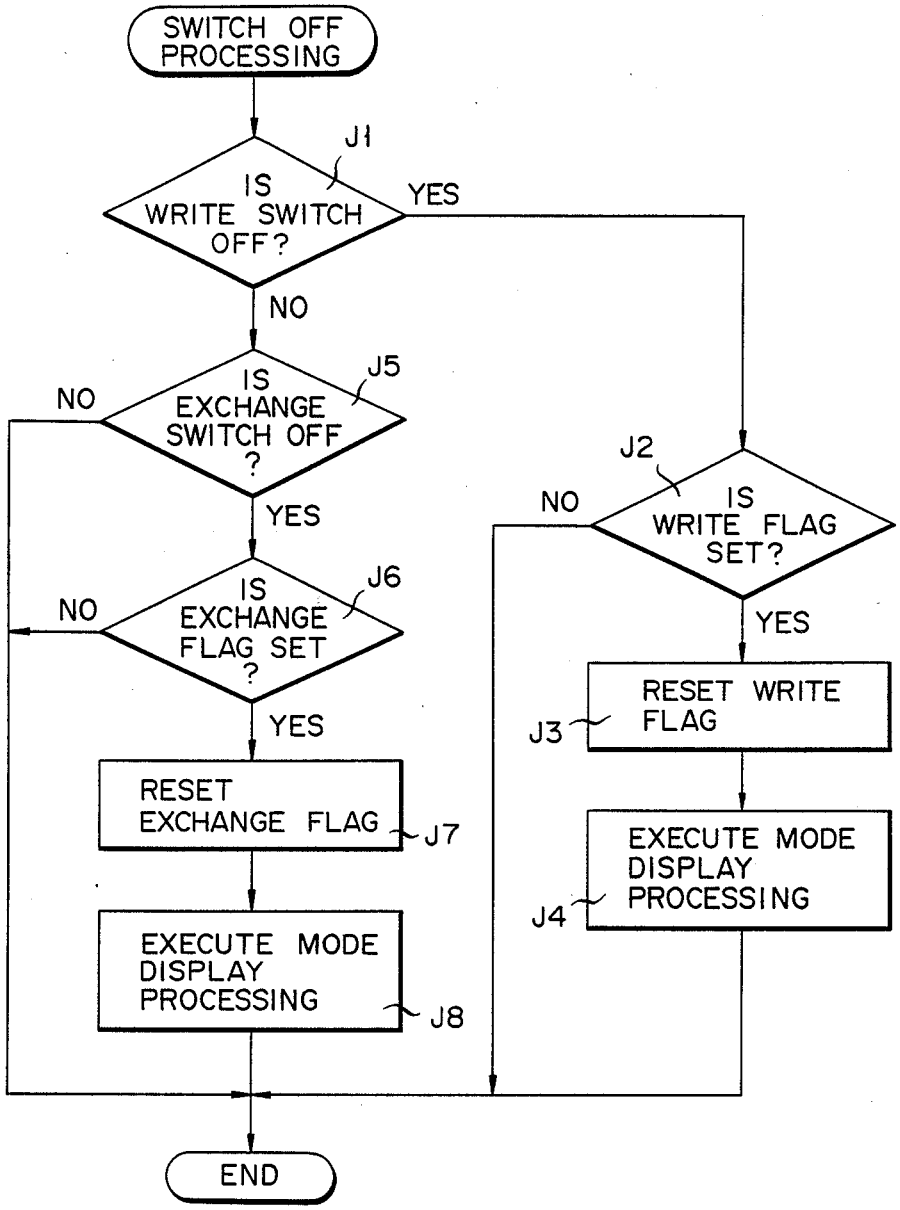

Bank switch 7 corresponding to the bank area to be copied can be turned on while write switch 9 is kept on. CPU 19 executes write/exchange processing in step B9 shown in FIGS. 7A to 7C based on the ON operation of write switch 9. More specifically, as shown in FIG. 16, CPU 19 determines in step I1 that write switch 9 is turned on, and thereafter, sets the write flag in RAM 23. Then, CPU 19 resets the bank A–H selection flag and the operation flag (step I2), and causes LCD display 17 to display a bank select message shown in FIG. 17, thereby requesting selection of a bank area by turning on bank switch 7 (step I3).

CPU 19 then performs bank switch processing in step B5 shown in FIGS. 7A to 7C based on the ON operation of switch Nos. A to H of bank switches 7. More specifically, as shown in FIG. 11, CPU 19 determines in step E1 that the write flag has already been set in step I2, and determines in step E5 that one of switch Nos. A to H of bank switches 7 is turned on. Then, CPU 19 sets the bank A–H selection flag in RAM 23 (step E6), and sets the bank number of the selected one of A to H in the destination number register (step E7). CPU 19 causes LED 18 corresponding to the selected one of switch Nos. A to H of bank switches 7 to be turned on (step E8).

Subsequently, based on the ON operation of bank switch 7 CPU 19 similarly determines in step E1 that the write flag is set, as shown in FIG. 11, and then determines in step E5 that one of switch Nos. 1 to 8 of bank switches 7 is turned on. After CPU 19 determines in step E9 that the bank A–H selection flag has already been set in step E6, it sets the bank number of the selected one of 1 to 8 in the destination number register (step E10). After CPU 19 determines in steps E11 and E12 that the write flag is set and the operation flag is reset in step I2, it checks if the operation flag is set (step E13). Since no operation flag is set, CPU 19 executes the copy processing in step E14 so that the operation data in current buffer CB is transferred to the area of operation bank OP corresponding to the bank number in the destination number register (step E14).

In this manner, operation data in one bank area of operation bank OP can be transferred and copied to another bank area, and this can facilitate editing of the operation data.

In this case, if the operation mode is not set, CPU 19 determines in step E13 that no operation flag is set, and executes the copy processing (step E15) so that timbre data in current buffer CB is transferred to the area of timbre bank VD corresponding to the bank number in the destination number register.

In order to exchange the operation data, exchange switch 8 can be turned on in place of write switch 9 in the copy processing described above, and other operations are the same as those described above.

In this case, as shown in FIG. 16, CPU 19 determines in steps I1 and I4 that exchange switch 8 is turned on, and thereafter, sets the exchange flag in RAM 23 and resets the bank A–H selection flag (step I5). Then, CPU 19 causes LCD display 17 to display a bank select message shown in FIG. 17, thereby requesting selection of a bank area by turning on bank switch 7 (step I6).

Figure 11A:
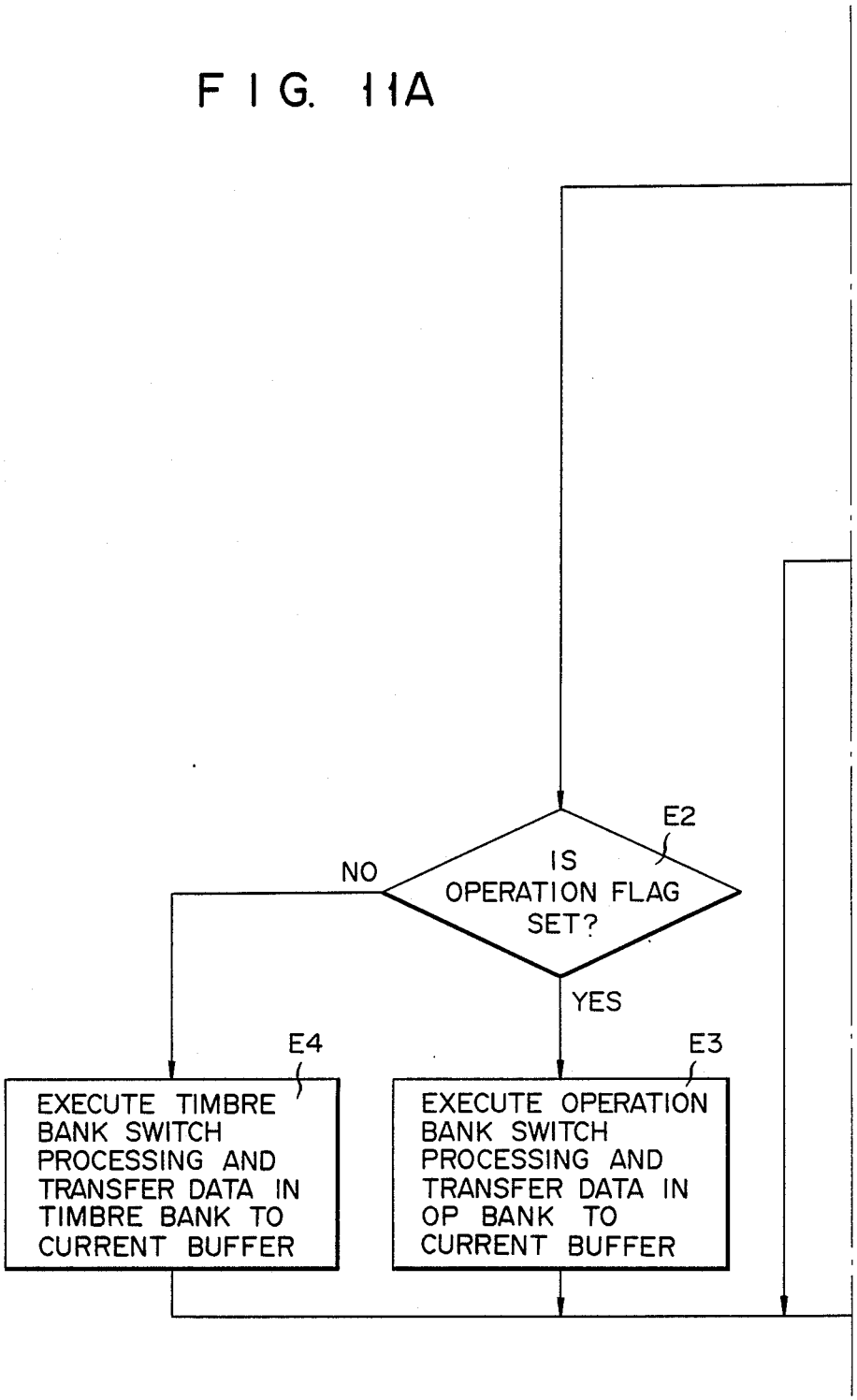
Figure 11B:
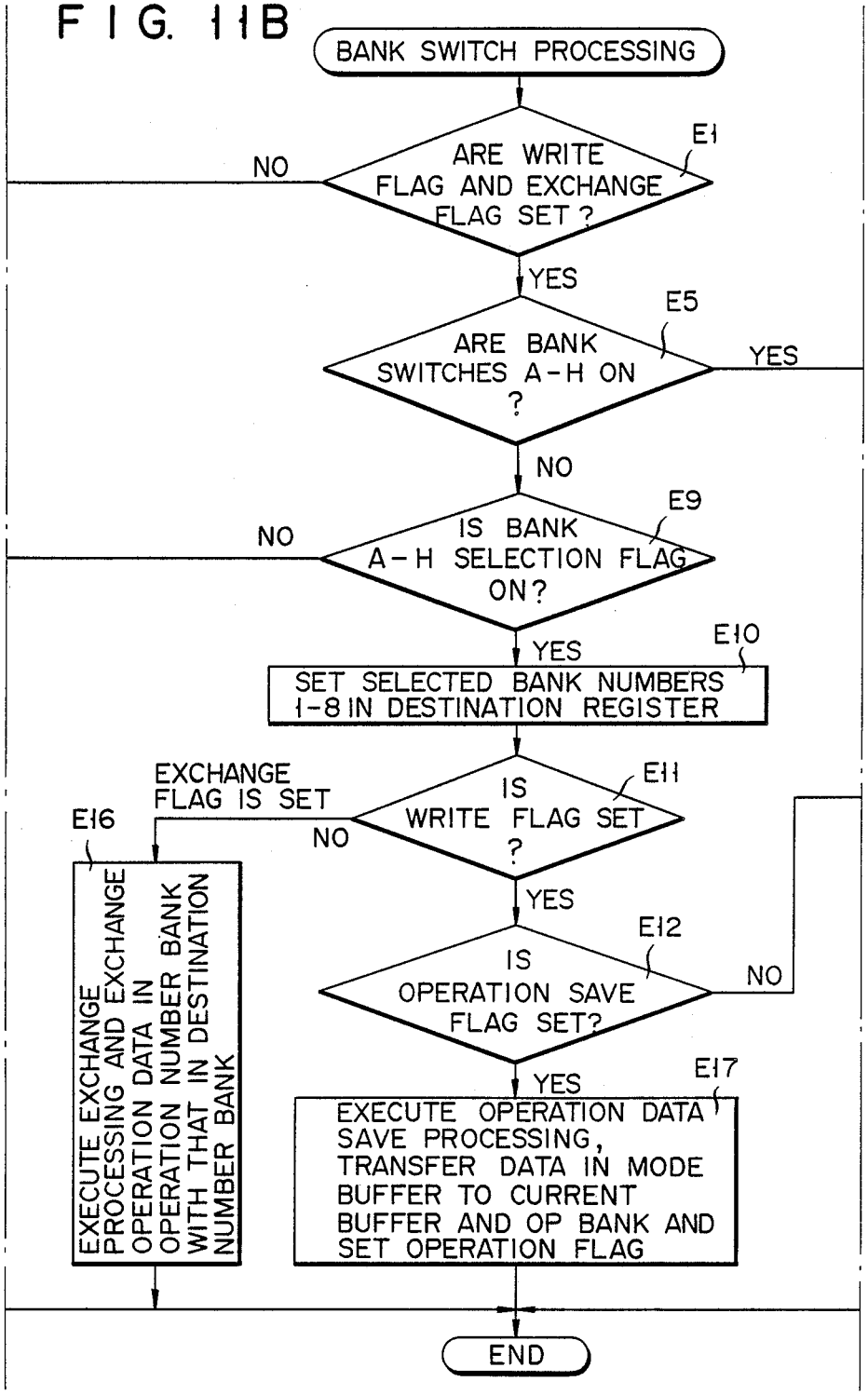
Figure 11C:
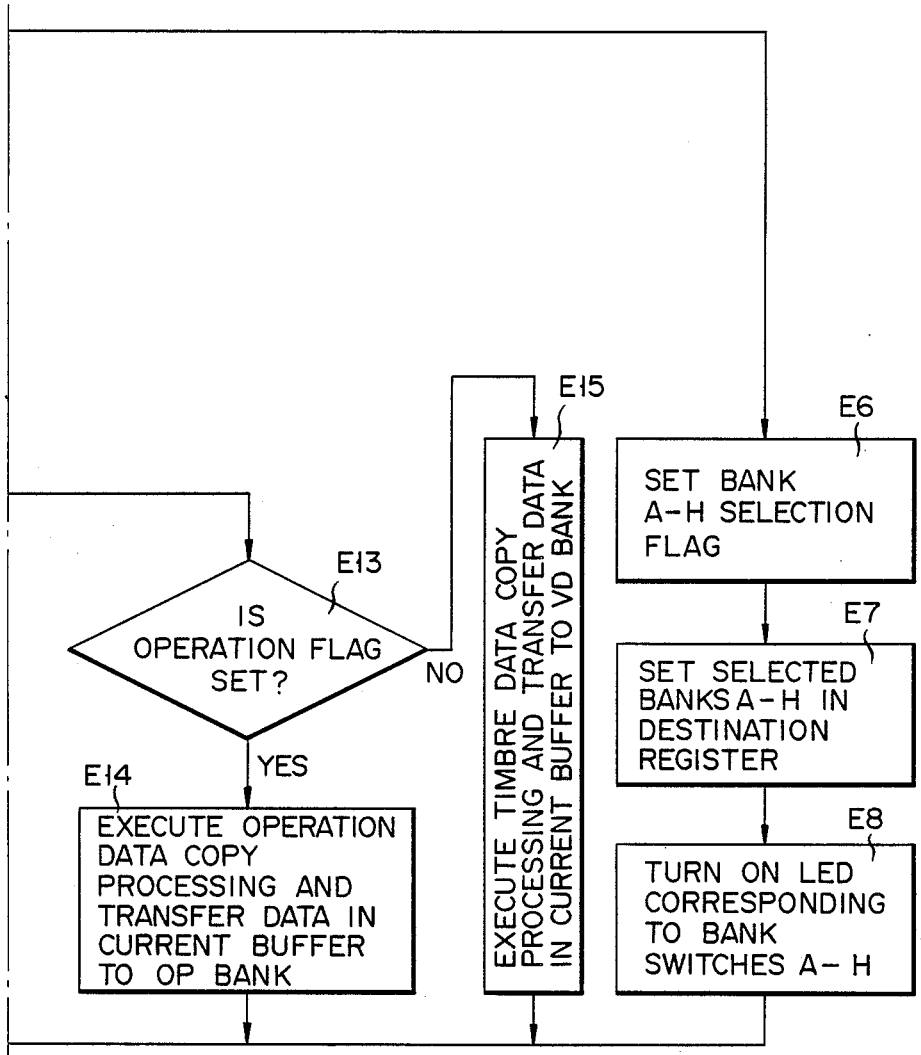

CPU 19 executes processing for setting a destination bank number in the destination number register in steps E1, and E5 to E8, and steps E1, E5, and E9 to E11 in FIGS. 11A to 11C based on the ON operation of bank switch 7, and determines in step E11 that the write flag is not set in step E11 and the exchange flag is set in step I5. CPU 19 then executes exchange processing wherein operation data in a bank area of operation bank OP designated by the operation number register is exchanged with operation data in a bank area designated by the destination number register (step E16). In this case, the operation data in the bank area designated by the operation number register is temporarily transferred to mode buffer MB, and operation data in the bank area designated by the destination number register is transferred to current buffer CB. Then, the data in buffer CB is transferred to the bank area designated by the operation number register, and data in buffer MB is transferred to the bank area designated by the destination number register.

In this manner, operation data in two bank areas of operation bank OP can be exchanged, and this can facilitate editing of operation data.

Operation data transfer (save) processing upon setting of the operation mode

In a mode other than the operation mode, when operation data which is set at panel switch section 1 and is stored in mode buffer MB is to be transferred to and saved in operation bank OP, operation switch 2 is turned on while pressing write switch 9, and then, bank switch 7 corresponding to the bank area where data is saved of operation bank OP is turned on while pressing write switch 9.

CPU 19 executes processing in steps I1 to I3 in FIG. 16 based on the ON operation of write switch 9, and sets the write flag in RAM 23. Subsequently, based on the ON operation of operation switch 2 CPU 19 determines in step C1 that the write flag is set, as shown in FIG. 8, and thereafter determines in step C6 that the operation flag is not yet set. Then, CPU 19 discriminates the ON operation of operation switch 2 (step C7) to set the operation save flag, and turns on LED 18 of operation switch 2 (steps C8 and C9).

CPU 19 performs processing for setting a destination bank number in the destination number register in steps E1 and E5 to E8, and steps E1, E5, and E9 to E11 in FIGS. 11A to 11C, based on bank switch 7 which is simultaneously turned on with write switch 9. CPU 19 determines in step E12 that an operation save flag has already been set in step C8. CPU 19 then executes save processing wherein the operation data in mode buffer MB is transferred to and saved in current buffer CB and the bank area of operation bank OP designated by the destination number register, and sets the operation flag (step E17).

Operation data set in the normal mode can be easily transferred to operation bank OP which is used in the operation mode, and can be used in the operation mode without modification.

The transfer (save) processing is also executed when effect data such as solo on/off data, effect value data such as a bender range, or the like is updated and the updated data is set in current buffer CB and mode buffer MB.

In a mode other than the operation mode, when one of solo switch 13, modulation wheel on/off switch 14, and portamento on/off switch 15 is turned on, CPU 19 executes inversion/update processing of solo, modulation, or portamento on/off data in current buffer CB in steps F1 to F5 shown in FIG. 12, and checks if the operation flag is set (step F6). Since the operation mode is not set and hence the operation flag is reset, the flow advances to step F8, and CPU 19 transfers and saves the inverted and updated operation data in current buffer CB to mode buffer MB and sets the operation flag (step F8).

The operation data which is updated in the normal mode can be used in the operation mode without modification. This also applies to an effect value such as a bender range, as will be described below.

Figure 14:
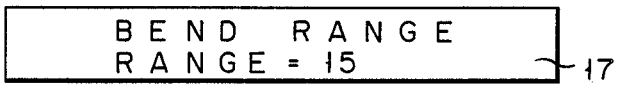

In a mode other than the operation mode, when one of bender range switch 10, modulation range switch 11, and portamento switch 12 is turned on and value switch 16 is also turned on, CPU 19 executes the effect value display processing in FIG. 14 and thereafter, executes update processing of effect value data such as bender range data in current buffer CB (steps H1 and H3 in FIG. 15). Then, CPU 19 checks if the operation flag is set (step H4). Since the operation mode is not set and hence the operation flag is reset, the flow advances to step H6, and CPU 19 transfers and saves the updated operation data in current buffer CB to mode buffer MB and sets the operation flag (step H6).

The operation data updated in the normal mode can be used in the operation mode without modification.

Operation data transfer (load) processing upon canceling of the operation mode

When operation data used in the operation mode is transferred and loaded in a mode other than the operation mode and the operation mode is to be canceled, operation switch 2 is turned on to set the operation mode, and operation data used in the operation mode is selected upon operation of corresponding bank switch 7 to read it out in current buffer CB. The detailed processing has been described in the paragraph of Operation mode setting and canceling processing, and is omitted herein.

One of normal switch 3, tone mix switch 4, and key split switch 5, LED 18 of which is turned on, is turned on while write switch 9 is kept on. CPU 19 executes the processing in steps I1 to I3 shown in FIG. 16 to set the write flag in RAM 23, and determines based on the ON operation of one of switches 3 to 5 in step C1 (FIG. 8) that the write flag is set. Thereafter, CPU 19 checks if the operation flag set (step C6). Since the operation mode is currently set and hence the operation flag is set, the flow advances to step C10, and CPU 19 determines in step C10 that one of switches 3 to 5, LED 18 of which is turned on, is turned on. Then, CPU 19 transfers operation data in current buffer CB to mode buffer MB (step C11). CPU 19 resets the operation flag in RAM 23, and sets the mode flag corresponding to the ON switch of switches 3 to 5 in the 3-mode register (step C12), thereby executing the mode state setting processing (step C13).

In the mode state setting processing, as shown in FIG. 9, after the tone generation off processing (step D1), CPU 19 determines in step D2 that the operation flag is reset in step C12. CPU 19 transfers the operation data set in mode buffer MB in step C11 before the operation mode is canceled, to current buffer CB (steps D6 to D9). CPU 19 sends the data in current buffer CB to tone generation section 20 and the like (step D4) to execute the mode display processing on LCD display 17 (step D5).

The operation data used in the operation mode can be used without modification in modes other than the operation mode. In the operation mode, since bank switches do not serve as timbre selection switches, only timbre data cannot be updated in the operation mode. However, when a mode other than the operation mode is selected without modifying the operation data, bank switches 7 can serve as timbre selection switches. Therefore, update processing of only timbre data can be facilitated even when operation data is used. The update processing of timbre data in this case can be performed in steps E1, E2, and E4 in FIGS. 11A to 11C.

Therefore, since operation data can be transferred from the operation mode to the one corresponding mode of the normal, tone mix, and key split modes, data associated with timbre that cannot be updated in the operation mode can be updated.

Switch off processing

When write switch 9 in the ON state is turned off (step J1), CPU 19 resets the write flag set in RAM 23 (steps J2 and J3) and executes the mode display processing (step J4). When exchange switch 8 in the ON state is turned off (steps J1 and J5), CPU 19 resets the exchange flag set in RAM 23 (steps J6 and J7) and executes the mode display processing (step J8).

In the above embodiment, operation data that can be updated in the operation mode and that can be transferred (saved) to mode buffer MB are effect on/off data such as solo on/off data and effect value data such as bender range data, but can be timbre data, rhythm data, and the like. In this case, special-purpose timbre switches or rhythm switches can be adopted and operated in the operation mode. The operation data can include various kinds of data such as the rhythm data described above.

What is claimed is:

1. An electronic musical instrument which is operable in a plurality of modes including an operation mode, comprising:

operation data storage means for storing a plurality of operation data items each including a combination of different timbre data and/or effect data;

operation mode selecting means for selecting an operation mode of the instrument for generating a musical tone by using one of said operation data items stored in said operation data storage means;

canceling means for canceling said operation mode selected by said operation mode selecting means and for selecting a mode other than said selected operation mode;

operator means operable by an operator of the instrument for designating one of said plurality of operation data items stored in said operation data storage means when the instrument is in said operation mode and for designating one of the timbre data and effect data allotted to said operator means when the instrument is in a mode other than said operation mode;

operation data read-out means for reading out from said operation data storage means the operation data item designated by said operator means when the instrument is in said operation mode;

tone generating means for generating a musical tone by using the operation data item read out by said operation data read-out means;

holding means for holding the operation data item read out while the instrument was in said operation mode when the mode other than said operation mode is selected by said canceling means when the instrument is in said operation mode;

updating means for updating the operation data item held in said holding means by changing timbre data and/or effect data included in the operation data item held in said holding means to designated timbre data or effect data by said operation means when the instrument is in the mode other than said operation mode; and writing means for writing the updated operation data item in said holding means into said operation data storage means.

2. The electronic musical instrument of claim 1, wherein said operator means includes a switch for designating timbre at the mode when said operation mode is canceled.

3. The electronic musical instrument of claim 1, wherein said writing means includes means for selecting said operation mode after the operation data items are written into said operation data storage means.

4. The electronic musical instrument of claim 3, wherein said operation data readout means includes means for reading out the updated operation data items from said operation data storage means, after said operation mode is selected by said operation data writing means.

5. An electronic musical instrument which is operable in a plurality of modes including an operation mode, comprising:

operation data storage means for storing a plurality of operation data items each including a combination of different timbre data and/or effect data;

operation mode selecting means for selecting an operation mode of the instrument for generating a musical tone by using one of said operation data items stored in said operation data storage means;

normal mode selecting means for selecting a normal mode of the instrument for generating a musical tone by using timbre data and/or effect data;

operator means operable by an operator of the instrument for designating one of said plurality of operation data items stored in said operation data storage means when the instrument is in said operation mode and for designating one of the timbre data and effect data allotted to said operator means when the instrument is in a mode other than said normal mode;

operation data read-out means for reading out from said operation data storage means the operation data item designated by said operator means when the instrument is in said operation mode;

tone generating means for generating a musical tone by using the operation data item read out by said operation data read-out means;

holding means for holding the operation data item read out while the instrument was in said operation mode when the normal mode is selected by said normal mode selecting means when the instrument is in said operation mode;

updating means for updating the operation data item held in said holding means by changing timbre data and/or effect data included in the operation data item held in said holding means to designated timbre data or effect data by said operation means when the instrument is in the mode other than said operation mode; and writing means for writing the updated operation data item in said holding means into said operation data storage means.

6. The electronic musical instrument of claim 5, wherein said operator means includes an operable device for designating timbre at said normal mode.

7. The electronic musical instrument of claim 5, wherein said writing means includes means for selecting said operation mode after the operation data item is written into said operation data storage means.

8. The electronic musical instrument of claim 7, wherein said operation data readout means includes means for reading out said updated operation data from said operation data storage means when the operation mode is selected by said writing means.

* * * * *